US009990915B2

(12) United States Patent
Pollet

(10) Patent No.: US 9,990,915 B2
(45) **Date of Patent: *Jun. 5, 2018**

(54) SYSTEMS AND METHODS FOR MULTI-STYLE SPEECH SYNTHESIS

(71) Applicant: Nuance Communications, Inc., Burlington, MA (US)

(72) Inventor: Vincent Pollet, Astene (BE)

(73) Assignee: Nuance Communications, Inc., Burlington, MA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/392,923

(22) Filed: Dec. 28, 2016

(65) Prior Publication Data

US 2017/0110110 A1 Apr. 20, 2017

Related U.S. Application Data

(63) Continuation of application No. 14/499,444, filed on Sep. 29, 2014, now Pat. No. 9,570,065.

(51) Int. Cl.

| | |
|---|---|
| ***G10L 13/027*** | (2013.01) |
| ***G10L 13/08*** | (2013.01) |
| ***G10L 13/07*** | (2013.01) |
| ***G10L 13/047*** | (2013.01) |

(52) U.S. Cl.

CPC ..... *G10L 13/027* (2013.01); *G10L 13/047* (2013.01); *G10L 13/07* (2013.01); *G10L 13/08* (2013.01)

(58) Field of Classification Search

CPC ..... G10L 13/027
USPC ..... 704/260
See application file for complete search history.

(56) References Cited

U.S. PATENT DOCUMENTS

| | | | | |
|---|---|---|---|---|
| 6,304,841 | B1 | 10/2001 | Berger et al. | |
| 7,096,183 | B2 | 8/2006 | Junqua | |
| 7,567,896 | B2 | 7/2009 | Coorman et al. | |
| 8,321,222 | B2 | 11/2012 | Pollet et al. | |
| 9,300,790 | B2 | 3/2016 | Gainsboro et al. | |
| 9,570,065 | B2 * | 2/2017 | Pollet | G10L 13/027 |
| 2016/0093289 | A1 | 3/2016 | Pollet | |

* cited by examiner

*Primary Examiner* — Susan McFadden
(74) *Attorney, Agent, or Firm* — Wolf, Greenfield & Sacks, P.C.

(57) ABSTRACT

Techniques for performing multi-style speech synthesis. The techniques include using at least one computer hardware processor to perform: obtaining input comprising text and an identification of a desired speaking style to use in rendering the text as speech; identifying a plurality of speech segments for use in synthesizing the text as speech, the identifying comprising identifying a first speech segment recorded and/or synthesized in a first speaking style that is different from the desired speaking style based at least in part on a measure of similarity between the desired speaking style and the first speaking style; synthesizing speech from the text in the desired speaking style at least in part by using the first speech segment; and outputting the synthesized speech.

20 Claims, 8 Drawing Sheets

SYSTEMS AND METHODS FOR MULTI-STYLE SPEECH SYNTHESIS

CROSS-REFERENCE TO RELATED APPLICATIONS

This application is a continuation of and claims the benefit under 35 U.S.C. § 120 of U.S. patent application Ser. No. 14/499,444, titled "SYSTEMS AND METHODS FOR MULTI-STYLE SPEECH SYNTHESIS," filed on Sep. 29, 2014, which is hereby incorporated by reference in its entirety.

BACKGROUND

Text-to-speech (TTS) synthesis involves rendering text as speech. Various TTS synthesis techniques exist including concatenative synthesis, sinewave synthesis, HMM-based synthesis, formant synthesis, and articulatory synthesis. TTS synthesis techniques may be used to render text as speech having desired characteristics such as content, pitch or pitch contour, speaking rate, and volume.

SUMMARY

Some embodiments are directed to a speech synthesis method. The method comprises using at least one computer hardware processor to perform: obtaining input comprising text and an identification of a first speaking style to use in rendering the text as speech; identifying a plurality of speech segments for use in rendering the text as speech, the identified plurality of speech segments comprising a first speech segment having the first speaking style and a second speech segment having a second speaking style different from the first speaking style; and rendering the text as speech having the first speaking style, at least in part, by using the identified plurality of speech segments.

Some embodiments are directed to a system. The system comprises at least one computer hardware processor; and at least one non-transitory computer-readable storage medium storing processor-executable instructions that, when executed by the at least one computer hardware processor, cause the at least one computer hardware processor to perform: obtaining input comprising text and an identification of a first speaking style to use in rendering the text as speech; identifying a plurality of speech segments for use in rendering the text as speech, the identified plurality of speech segments comprising a first speech segment having the first speaking style and a second speech segment having a second speaking style different from the first speaking style; and rendering the text as speech having the first speaking style, at least in part, by using the identified plurality of speech segments.

Some embodiments are directed to at least one computer-readable storage medium storing processor-executable instructions that, when executed by at least one computer hardware processor, cause the at least one computer hardware processor to perform: obtaining input comprising text and an identification of a first speaking style to use in rendering the text as speech; identifying a plurality of speech segments for use in rendering the text as speech, the identified plurality of speech segments comprising a first speech segment having the first speaking style and a second speech segment having a second speaking style different from the first speaking style; and rendering the text as speech having the first speaking style, at least in part, by using the identified plurality of speech segments.

The foregoing is a non-limiting summary of the invention, which is defined by the attached claims.

BRIEF DESCRIPTION OF DRAWINGS

Various aspects and embodiments will be described with reference to the following figures. It should be appreciated that the figures are not necessarily drawn to scale. Items appearing in multiple figures are indicated by the same or a similar reference number in all the figures in which they appear.

DETAILED DESCRIPTION

Some embodiments are directed to multi-style synthesis techniques for rendering text as speech in any one multiple different styles. For example, text may be rendered as speech having a style that expresses an emotion, non-limiting examples of which include happiness, excitement, hesitation, anger, sadness, and nervousness. As another example, text may be rendered as speech having a style of speech spoken for a broadcast (e.g., newscast speech, sports commentary speech, speech during a debate, etc.). As yet another example, text may be rendered as speech having a style of speech spoken in a dialogue among two or more people (e.g., speech from a conversation among friends, speech from an interview, etc.). As yet another example, text may be rendered as speech having a style of speech spoken by a reader reading content aloud. As yet another example, text may be rendered as speech having a particular dialect or accent. As yet another example, text may be rendered as speech spoken by a particular type of speaker (e.g., a child/adult/elderly male or female speaker). The above-described examples of speech styles are illustrative and not limiting, as the TTS synthesis techniques described herein may be used to generate speech having any other suitable style.

The conventional approach to enabling a concatenative TTS system to render input text as speech in any one of multiple speech styles involves creating, for each speaking style, a database of speech segments by segmenting recordings of speech spoken in that style. In response to a user request to render input text as speech having a specified style, the conventional TTS system renders the input text as speech by using speech segments from the database of speech segments corresponding to the specified style. As a result, to render text as speech having a specified style, conventional TTS systems use only those speech segments that were obtained from recordings of speech spoken in the specified style. However, the inventors have recognized that obtaining a speech database having an adequate number of speech segments to allow for high-quality synthesis for each of multiple speaking styles is expensive and time-consuming. Additionally, storing a speech segment database for each speaking style requires more storage space than is available in some TTS systems.

Figure 1:
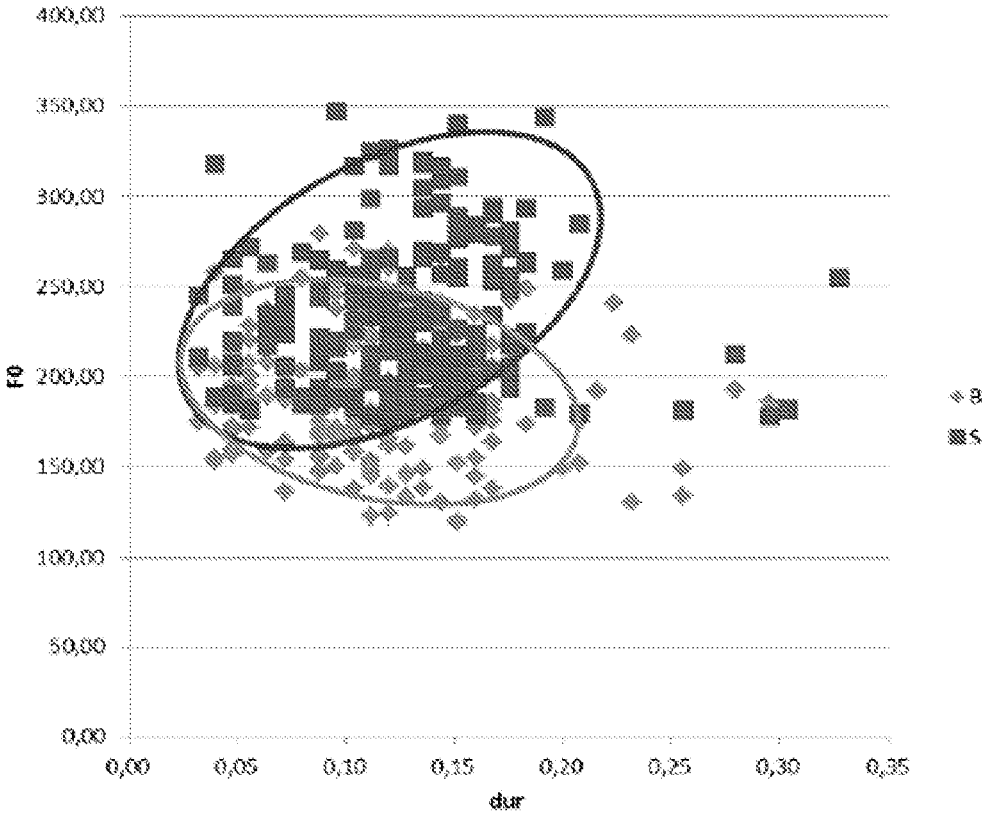
FIG. 1 illustrates overlap in prosodic characteristics of speech segments spoken in different speaking styles.

The inventors have recognized that acoustic and/or prosodic characteristics of some speech segments obtained from speech having one style may be similar to acoustic and/or prosodic characteristics of speech segments obtained from speech having another style. For example, as shown in FIG. 1, prosodic characteristics (e.g., average duration and average pitch frequency) of newscast speech segments (indicated by squares) and sports commentary speech segments (indicated by diamonds) largely overlap. The inventors have appreciated that speech segments obtained from speech having one style may be used for generating speech having another style. As one non-limiting example, input text may be rendered as newscast style speech at least in part by using sports commentary speech segments. Using speech segments obtained from different styles of speech to generate speech having a desired style reduces the cost of implementing TTS systems configured to perform multi-style synthesis (i.e., to render text as speech in any one of multiple speech styles).

Accordingly, some embodiments are directed to rendering input text as speech having a particular speaking style by using speech segments having one or more other speaking styles. For example, input text may be rendered as speech having a newscast style by using one or more speech segments having the newscast style (e.g., obtained from a recording of speech having the newscast style, synthesized to have characteristics of a newscast style, etc.), one or more speech segments having a sports commentary style, one or more speech segments having a neutral style, and/or one or more speech segments having any other suitable style. As another example, input text may be rendered as speech expressing happiness by using one or more segments of speech expressing happiness, one or more segments of speech expressing excitement, one or more segments of speech expressing hesitation, one or more segments of speech expressing sadness, and/or one or more speech segments having any other suitable style.

In some embodiments, a TTS system may receive input comprising text and information specifying a style to use in rendering the text as speech and, based on the input, identify one or more speech segments having a style other than the specified style to use for rendering the text as speech. The TTS system may identify a particular speech segment having a style other than the specified style as a speech segment to use for rendering text in the specified style based, at least in part, on how well acoustic and/or prosodic characteristics of the particular speech segment match acoustic and/or prosodic characteristics associated with the specified style. For example, a speech segment having a sports commentary style may be selected for use in generating newscast style speech when acoustic and/or prosodic characteristics of the speech segment are close to those of the newscast style.

In some embodiments, the extent to which acoustic and/or prosodic characteristics of a speech segment having one style match those of another style may be obtained based on a measure of similarity between speech segments of different speaking styles. Similarity between speech segments of speaking styles may be estimated, prior to using the TTS system for multi-style speech synthesis, by training the TTS system using multi-style speech data (e.g., one or more speech segments obtained from speech having a first style, one or more speech segments obtained from speech having a second style, one or more speech segments obtained from speech having a third style, etc.). Thus, aspects of the multi-style synthesis technology described herein relate to training a TTS system to calculate how well acoustic and/or prosodic characteristics of speech segments of one style match acoustic and/or prosodic characteristics of another style (e.g. as described with reference to FIG. 5 below) and using the trained TTS system to perform multi-style synthesis (e.g., as described with reference to FIGS. 3-4 below).

In some embodiments, a multi-style TTS system may be trained based on multi-style speech data to estimate similarity between (e.g., similarity of acoustic and/or prosodic characteristics of) speech segments having different styles. For example, a multi-style TTS system may be trained to estimate similarity between any pair of speech segments having different styles. As another example, a multi-style TTS system may be trained to estimate similarity between a group of speech segments having one style and another group of speech segments having another style, but with both groups of speech segments being associated with the same phonetic context (e.g., all speech segments in each group are associated with the same phonetic context).

In embodiments where a multi-style TTS system is trained to estimate similarities between groups of speech segments having different styles, training the multi-style TTS system may comprise estimating transformations from groups of segments having one style, and associated with respective phonetic contexts, to groups of segments having another style, and associated with the same respective phonetic contexts. For example, training the multi-style TTS system may comprise estimating, for a group of speech segments having a first style (e.g., newscast speech) and associated with a phonetic context (e.g., the phoneme /t/ occurring at the beginning of a word and followed by the phoneme /ae/), a transformation to a corresponding group of speech segments having a second style (e.g., sports commentary speech) and associated with the same particular phonetic context. A transformation may be a transformation from acoustic and/or prosodic parameters representing the first group of speech segments to acoustic and/or prosodic parameters representing the second group of speech segments. The transformation may be a linear transformation or any other suitable type of transformation. The obtained transformations may be used to calculate values indicative of similarities between speech segments in the groups that, as described in more detail below, may be used to select speech segments having one style for use in rendering text as speech having another style.

As used herein, a speech segment may comprise recorded speech and/or synthesized speech. For example, a speech segment may comprise an audio recording of speech (e.g., speech spoken in a particular style). As another example, a speech segment may be synthesized (e.g., using parametric synthesis techniques) to generate the speech segment from any suitable set of speech parameters (e.g., a speech segment may be synthesized to have a specified style by using acoustic and prosodic parameters associated with the specified style).

It should be appreciated that the embodiments described herein may be implemented in any of numerous ways. Examples of specific implementations are provided below for illustrative purposes only. It should be appreciated that these embodiments and the features/capabilities provided may be used individually, all together, or in any combination of two or more, as aspects of the technology described herein are not limited in this respect.

Figure 2A:
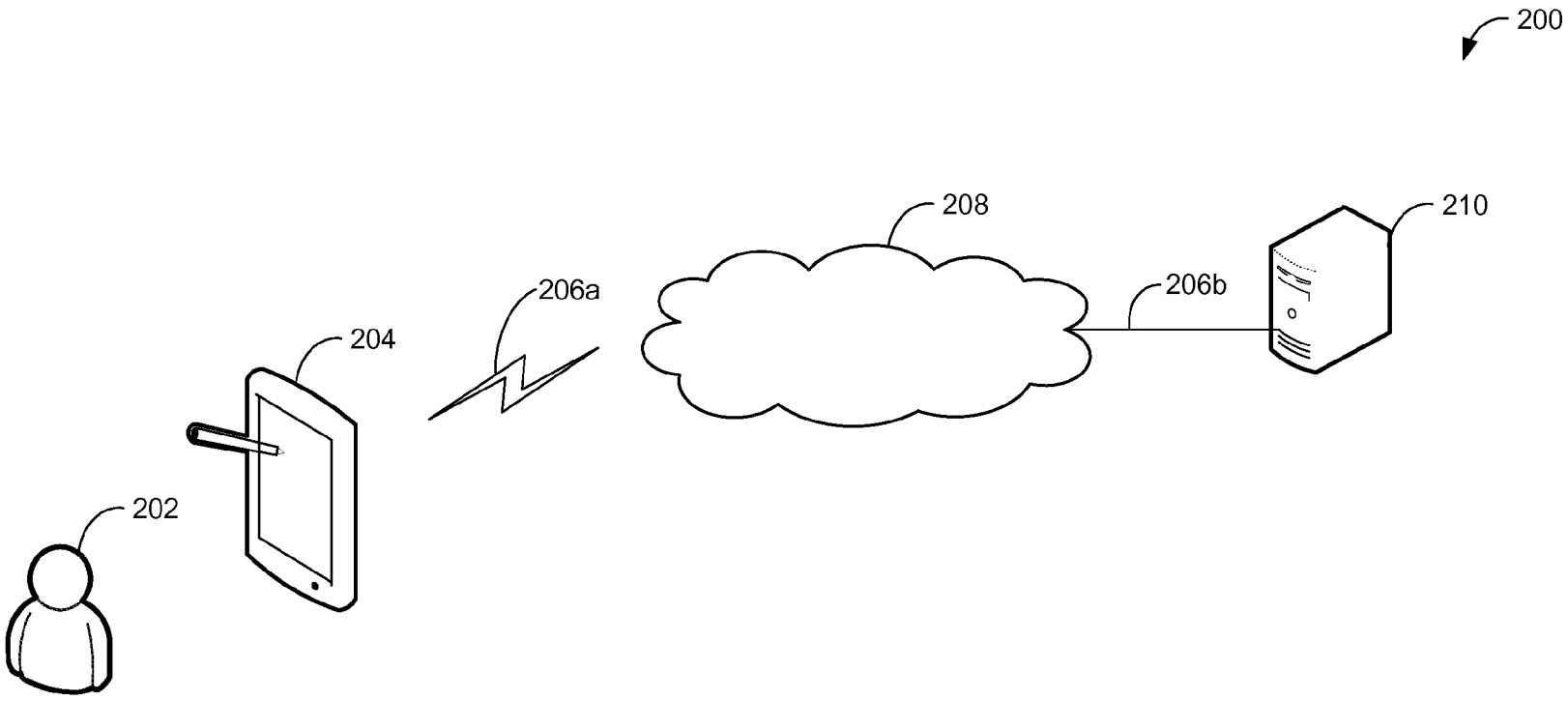
FIG. 2A shows an illustrative environment in which some embodiments of the technology described herein may operate.

FIG. 2A shows an illustrative environment 200 in which some embodiments of the technology described herein may operate. In the illustrative environment 200, computing device 204 may audibly present user 202 with speech generated in accordance with any one or more (e.g., some or all) of the text-to-speech synthesis techniques described herein. For example, one or more computer programs (e.g., operating system, an application program, a voice assistant computer program, etc.) executing on computing device 204 may be configured to audibly present user 202 with speech having a specified style that was generated using one or more speech segments having a style different from the specified style. As another example, one or more computer programs executing on device 204 may be configured to audibly present user 202 with speech generated in accordance with the adaptive speech synthesis techniques described herein (e.g., with reference to FIG. 5). As yet another example, one or more computer programs executing on device 204 may be configured to audibly present user 202 with speech generated in accordance with the iterative search speech synthesis techniques described herein (e.g., with reference to FIG. 6).

Computing device 204 may be any electronic device that may audibly present user 202 with speech generated from text and may comprise any hardware component(s) to perform or facilitate performance of this functionality (e.g., one or more speakers, an audio output interface to which one or more external speakers may be coupled, etc.). In some embodiments, computing device 204 may be a portable device such as a mobile smart phone, a personal digital assistant, a laptop computer, a tablet computer, a wearable computer such as a smart watch, or any other portable device that may be configured to audibly present user 202 with speech generated from text. Alternatively, computing device 204 may be a fixed electronic device such as a desktop computer, a server, a rack-mounted computed, or any other suitable fixed electronic device that may be configured to audibly present user 202 with speech generated from text.

Computing device 204 may be configured to communicate with server 210 via communication links 206*a* and 206*b* and network 208. Each of communication links 206*a* and 206*b* may be a wired communication link, a wireless communication link, a combination of a wired and wireless links, or any other suitable type of communication link. Network 208 may be any suitable type of network such as a local area network, a wide area network, the Internet, an intranet, or any other suitable network. Server 210 may comprise one or more computing devices (e.g., one or more servers that may be located in one or multiple different physical locations). Server 210 may be part of a cloud-computing infrastructure for providing cloud-based services, such as text-to-speech and automatic speech recognition services, for example. Computing device 204 and server 210 may communicate through any suitable communication protocol (e.g., a networking protocol such as TCP/IP), as the manner in which information is transferred between computing device 204 and server 210 is not a limitation of aspects of the technology described herein.

In the illustrated embodiment, server 210 may be configured to render input text (e.g., text received from computing device 204, such as text input by user 202 or text provided by a computer program executing on computing device 204, or from any other suitable source) as speech and transmit a representation of the generated speech to computing device 204 such that computing device 204 may audibly present the generated speech to user 202. Server 210 may be configured to render input text as speech using any of the text-to-speech synthesis techniques described herein. However, in other embodiments, input text may be generated at least in part by using computing resources of computing device 204 rather than being generated entirely using server 210 alone. Accordingly, input text may be rendered as speech by using computing device 204, by using server 210, or at least in part by using computing device 204 and at least in part by using server 210.

Figure 2B:
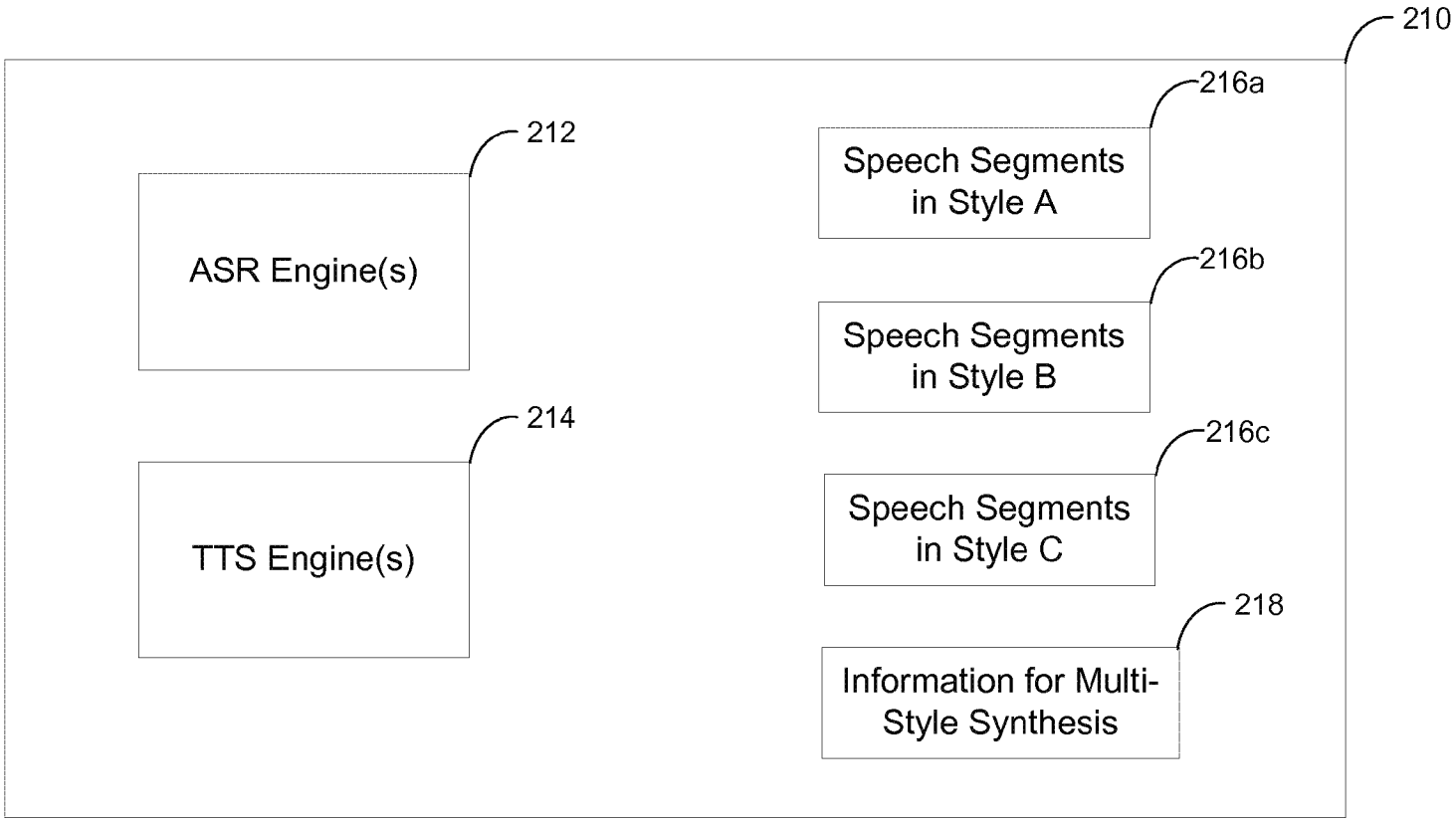
FIG. 2B illustrates components of a server operating in the illustrative environment of FIG. 2A and configured to perform functions related to automatic speech recognition and text-to-speech synthesis, in accordance with some embodiments of the technology described herein.

FIG. 2B illustrates some components of server 210 that may be used in connection with automatic speech recognition (ASR) and text-to-speech synthesis, in accordance with some embodiments of the technology described herein. As shown, server 210 comprises ASR engine(s) 212 configured to process speech to generate a textual representation of the speech and TTS engine(s) 214 configured to render text as speech. Though, in some embodiments, server 210 may not perform any ASR-related functionality, as aspects of the technology described herein are not required to have ASR-related functionality.

ASR engine(s) 212 may be configured to process speech signals (e.g., obtained via a microphone of computing device 204 and transmitted to server 210, speech segments stored in one or more TTS databases accessible by TTS engine(s) 214, etc.) to produce a textual representation of the speech. ASR engine(s) 212 may comprise one or more computer programs that, when executed on one or more processors, are configured to convert speech signals to text (e.g., programs forming ASR engine(s) 125 may be executed on processor(s) part of server 210). The one or more programs forming, in part, ASR engine(s) 212 may be stored on one or more non-transitory computer readable storage media of server 210, and/or stored on one or more non-transitory computer readable storage media located remotely from and accessible by server 210 (e.g., via a network connection). In this respect, ASR engine(s) 212 may comprise a combination of software and hardware (e.g., program instructions stored on at least one non-transitory computer readable storage medium and one or more processors to execute the instructions).

ASR engine(s) 212 may process speech signals using one or more acoustic models, language models, and/or any one or combination of suitable speech recognition techniques, as aspects of the invention are not limited by the specific implementation of the ASR engine(s). ASR engine(s) 212 may comprise one or more dictionaries, vocabularies, grammars and/or other information that is used during or facilitates speech recognition.

TTS engine(s) 214 may comprise one or more computer programs that, when executed on one or more computer processors, convert text into speech. The one or more computer programs forming, in part. TTS engine(s) 214 may be stored on one or more non-transitory computer readable storage media of server 210, and/or stored on one or more non-transitory computer readable storage media located remotely from and accessible by server 210 (e.g., via a network connection).

Figure 5:
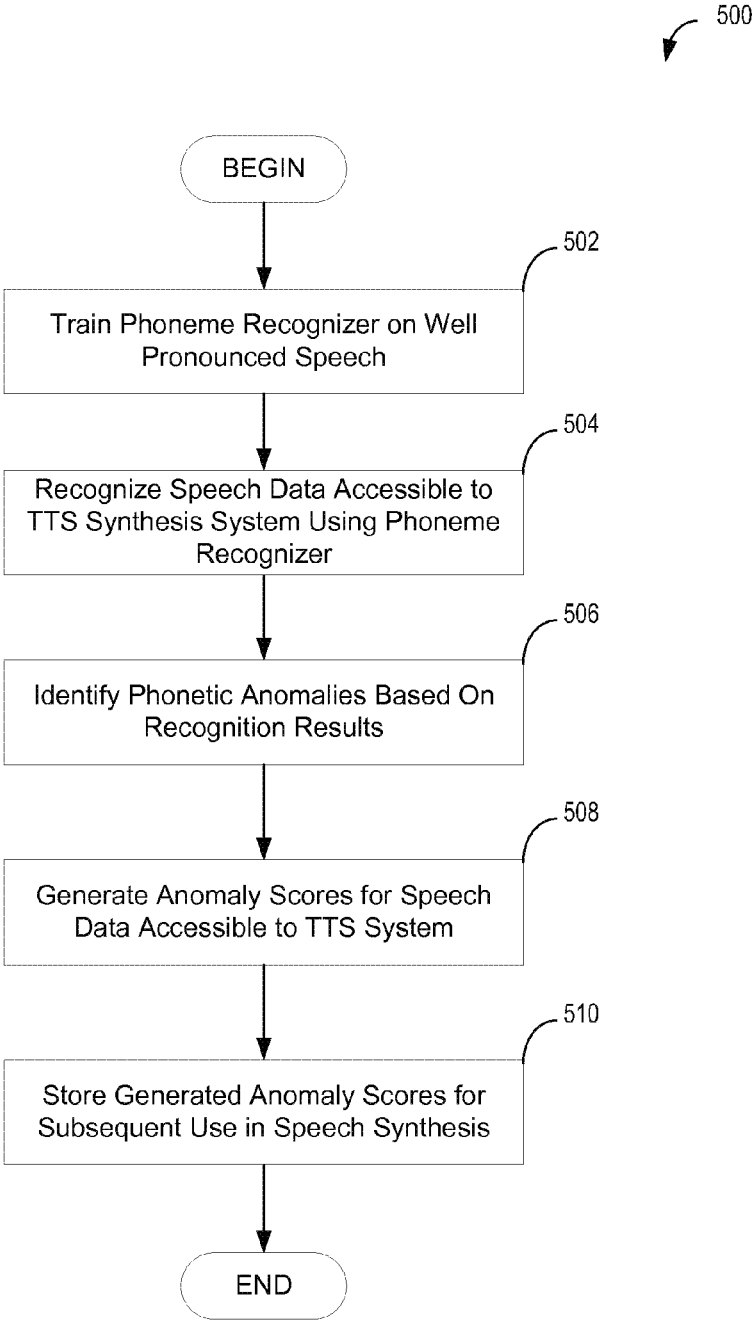
FIG. 5 is a flowchart of an illustrative process for identifying phonetic anomalies in speech data accessible by a TTS system at least in part by using automatic speech recognition, in accordance with some embodiments of the technology described herein.
Figure 6:
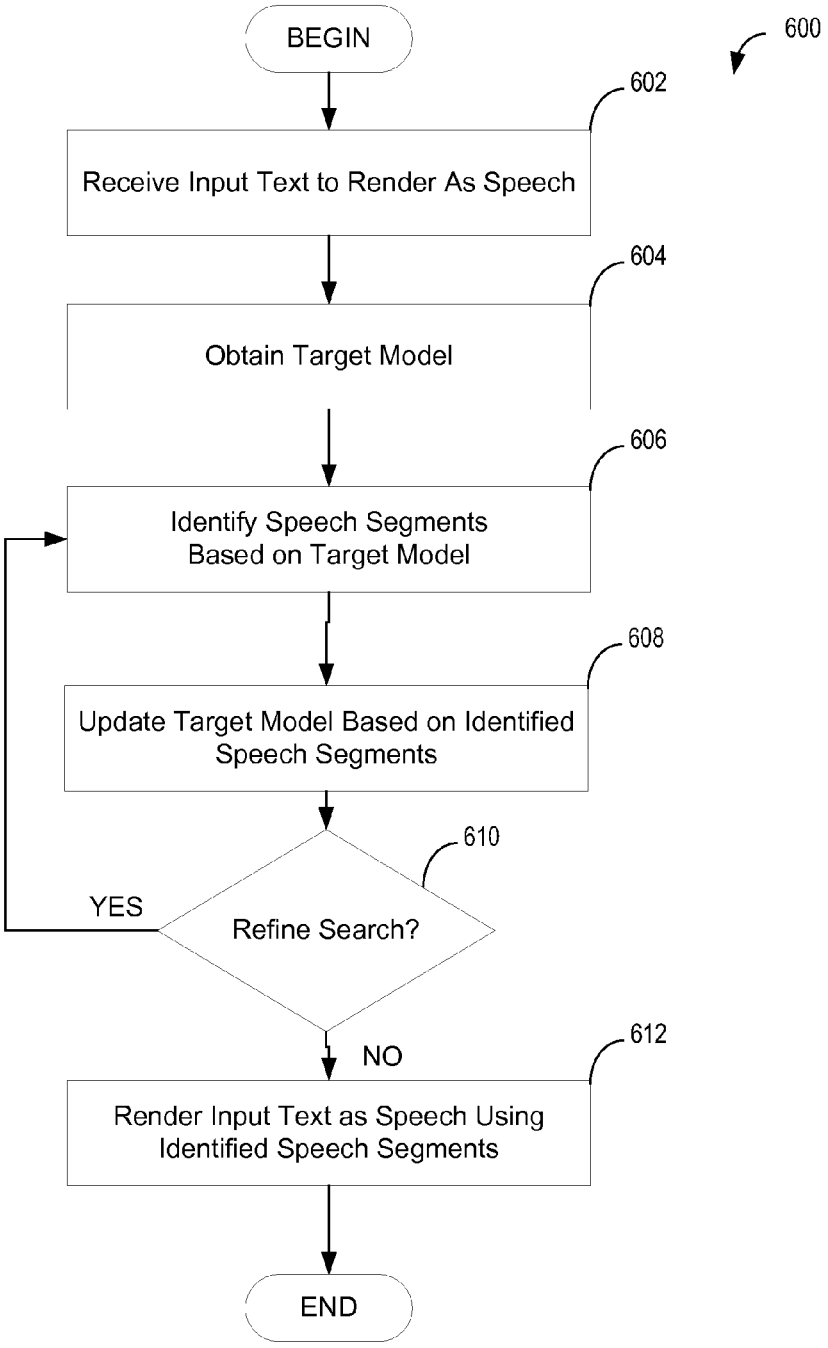
FIG. 6 is a flowchart of an illustrative process for performing a multi-pass search for speech segments to use for rendering input text as speech via concatenative synthesis, in accordance with some embodiments of the technology described herein.

TTS engine(s) 214 may be configured to render text as speech using any one or more (e.g., some or all) of the TTS techniques described herein including multi-style speech synthesis (described herein at least in part by reference to FIGS. 1, 2A, 2B, 3, and 4), adaptive speech synthesis (described herein at least in part by reference to FIG. 5), and/or iterative search speech synthesis (described herein at least in part by reference to FIG. 6). TTS engine(s) 214 may be configured to perform any of the TTS techniques described herein using any suitable approach to speech synthesis including, but not limited to, one or any combination of concatenative synthesis, sinewave synthesis, HMM-based synthesis, formant synthesis, articulatory synthesis, etc., as aspects of the technology described herein are not limited to any specific type of implementation of a TTS engine. For example, although TTS engine(s) 214 may perform multi-style speech synthesis by using concatenative synthesis, one or more other speech synthesis techniques may be employed as well (e.g., one or more of the speech segments used for rendering speech having a specified style may be generated using HMM-based synthesis).

Accordingly, in some embodiments, TTS engine(s) 214 may be configured to perform multi-style synthesis and render text as speech having a specified style using one or more speech segments having a style other than the specified style (in addition to or instead of one or more speech segments having the specified style). In the illustrated embodiment, TTS engine(s) 214 may be configured to perform multi-style synthesis using speech segments in speech segment inventory 216A (speech segments having one style "A," for example newscast speech), speech segment inventory 216B (speech segments having style "B," for example speech spoken with a particular dialect or accent), and speech segment inventory 216C (e.g., speech segments having style "C," for example speech spoken by a professional reader reading content aloud). For example, TTS engine(s) 214 may be configured to generate speech having style "A" by using one or more speech segments having style "B" and/or one or more speech segments having style "C" (in addition to or instead of one or more speech segments having style "A"). In the illustrated embodiment, TTS engine(s) 214 may use speech segments of three different speech styles to generate speech having a specified style (i.e., speech segment from inventories 216A, 216B, and 216C). This is merely illustrative. One or more speech segments of each of any suitable number of styles (e.g., one, two, three, four, five, ten, twenty-five, etc.) may be used to generate speech having a specified style, as aspects of the technology described herein are not limited in this respect.

In some embodiments, a speech segment inventory (e.g., inventories 216A, 216B, and 216C) may comprise multiple speech segments of any suitable type (e.g., audio recordings, synthesized segments). A speech segment inventory may be stored in any suitable way (e.g., using one or more non-transitory computer-readable storage media such as one or more hard disks).

In some embodiments, TTS engine(s) 214 may be configured to perform multi-style speech synthesis at least in part by using multi-style synthesis information 218, which comprises information that may be used to determine similarity (e.g., acoustic and/or prosodic similarity) among speech segments and/or groups of speech segments having different speech styles. Multi-style synthesis information 218 may include values indicative of the similarity among speech segments and/or groups of speech segments and/or information that may be used to calculate these values. In turn, the values indicative of similarity between speech segments and/or groups of speech segments having different styles may be used to select (such values may be termed "style costs") one or more speech segments of one style to generate speech in another style, as described in more detail below with reference to FIG. 3.

In some embodiments, multi-style synthesis information 218 may comprise information that may be used to determine (e.g., calculate values indicative of) similarity between pairs of groups of speech segments, with each group of speech segments having different styles, but associated with the same phonetic context. For example, multi-style synthesis information 218 may comprise a transformation from a group of speech segments having a first style (e.g., newscast speech) and associated with a particular phonetic context (e.g., the phoneme /t/ occurring at the beginning of a word and followed by the phoneme /ae/) to a corresponding group of speech segments having a second style (e.g., sports commentary speech) and associated with the same phonetic context. The transformation, in turn, may be used to calculate (e.g., as described below) a value indicative of acoustic and/or prosodic similarity between the two groups of speech segments. Multi-style synthesis information 218 may comprise the transformation and/or the value calculated using the transformation. Accordingly, multi-style synthesis information 218 may comprise one or more transformations between groups of speech segments having different styles and/or one or more values calculated using the transformation(s) and indicative of an amount of similarity between these groups of speech segments. The transformations may be stored as part of multi-style synthesis information 218 in any suitable way using any suitable format or representation.

In some embodiments, two groups of speech segments having different styles may be represented by respective statistical models, and a transformation from a first group of speech segments having one style to a second group of speech segments having another style may be a transformation of the statistical model representing the first group to obtain a transformed statistical model that matches (e.g., in the log likelihood sense or in any other suitable way) characteristics of speech segments in the second group. Similarly, a transformation from the second group of speech segments having the other style may be a transformation of the statistical model representing the second group to obtain a transformed statistical model that matches characteristics of speech segments in the first group. The two transformations may be inverses of each other.

As one example, a first group of speech segments having a first speech style and associated with a phonetic context may be represented by a Gaussian distribution and the transformation from the first group to a second group of speech segment having a second speech style and associated with the same phonetic context may be a transformation applied to the parameters of the Gaussian distribution to obtain a transformed Gaussian distribution that matches characteristics of speech segments in the second group. In this example, the mean and covariance parameters of the Gaussian distribution may represent acoustic and/or prosodic features (e.g., Mel-frequency cepstral coefficients (MFCCs), pitch, duration, and/or any other suitable features) of speech segments in the first group, and the transformation between the first and second groups may be a transformation of the mean and/or covariance parameters of the first Gaussian distribution such that the transformed Gaussian distribution matches characteristics of speech segments in the second group. It should be appreciated that a group of speech segments associated with a particular phonetic context are not limited to being represented by a Gaussian distribution and may be represented by any suitable statistical model (e.g., a Gaussian mixture model), as aspects of the technology described herein are not limited by the type of statistical model that may be used to represent a group of speech segments associated with a particular phonetic context.

A transformation between two groups of speech segments may be used to calculate a value indicative of the similarity (e.g., acoustic and/or prosodic similarity) between the two groups of speech segments. For example, in embodiments where the two groups of segments are represented by respective statistical models, a value indicative of the similarity between the two groups may be obtained by: (1) using the transformation to transform the first statistical model to obtain a transformed first statistical model; and (2) calculating the value as a distance (e.g., Kullback-Liebler (KL) divergence, L1 distance, weighted L1 distance, L2 distance, weighted L2 distance, or any other suitable measure of similarity) between the transformed first statistical model and the second statistical model. As a specific non-limiting example, when a first group of segments is represented by a first Gaussian distribution and the second group of segments is represented by a second Gaussian distribution, a value indicative of the similarity between the two groups may be obtained by: (1) using the transformation to transform the first Gaussian distribution; and (2) calculating the value as a distance (e.g., KL divergence, L1 distance, weighted L1 distance, L2 distance, weighted L2 distance, etc.) between the probability density functions of the transformed distribution and the second Gaussian distribution.

In some embodiments, a transformation between first and second groups of speech segments having different styles, but associated with the same phonetic context, may be specified as a composition of two different transformations: (1) a transformation from the first group of speech segments to an average style group of speech segments associated with the same phonetic context as the first and second groups; and (2) a transformation from the average style group to the second group of speech segments. The average style group of speech segments may comprise speech segments having multiple different speech styles, but sharing the same phonetic context as the first and second groups. For example, each of speech segment inventories 216A, 216B, and 216C may comprise respective groups of speech segments associated with the same phonetic context-phonetic context "P"—and the average style group of speech segments may include (some or all of) the speech segments from speech segment inventories 216A, 216B, and 216C that are associated with phonetic context P. Accordingly, the transformation between a first group of style "A" speech segments and associated with phonetic context P and a second group of style "C" speech segments also associated with phonetic context P may be a composition of two transformations: (1) a transformation from the first group of speech segments (including style "A" speech segments only) to the average style group (including style "A" speech segments, style "B" speech segments, and style "C" speech segments); and (2) a transformation from the average style group of speech segments to the second group of speech segments (including style"C" speech segments only).

A phonetic context of a speech segment may include one or more characteristics of the speech segment's environment (e.g., one or more characteristics of speech from which the speech segment was obtained when the speech segment is an audio recording, one or more characteristics indicative of how the speech segment was synthesized when the speech segment is synthetic, etc.). Such characteristics may include the identity of the phoneme to which the speech segment corresponds, identity of one or more preceding phonemes, identity of one or subsequent phonemes, pitch period/frequency of the speech segment, power of the speech segment, presence/absence of stress in the speech segment, speed/rate of speech segment, and/or any other suitable characteristics.

Figure 3:
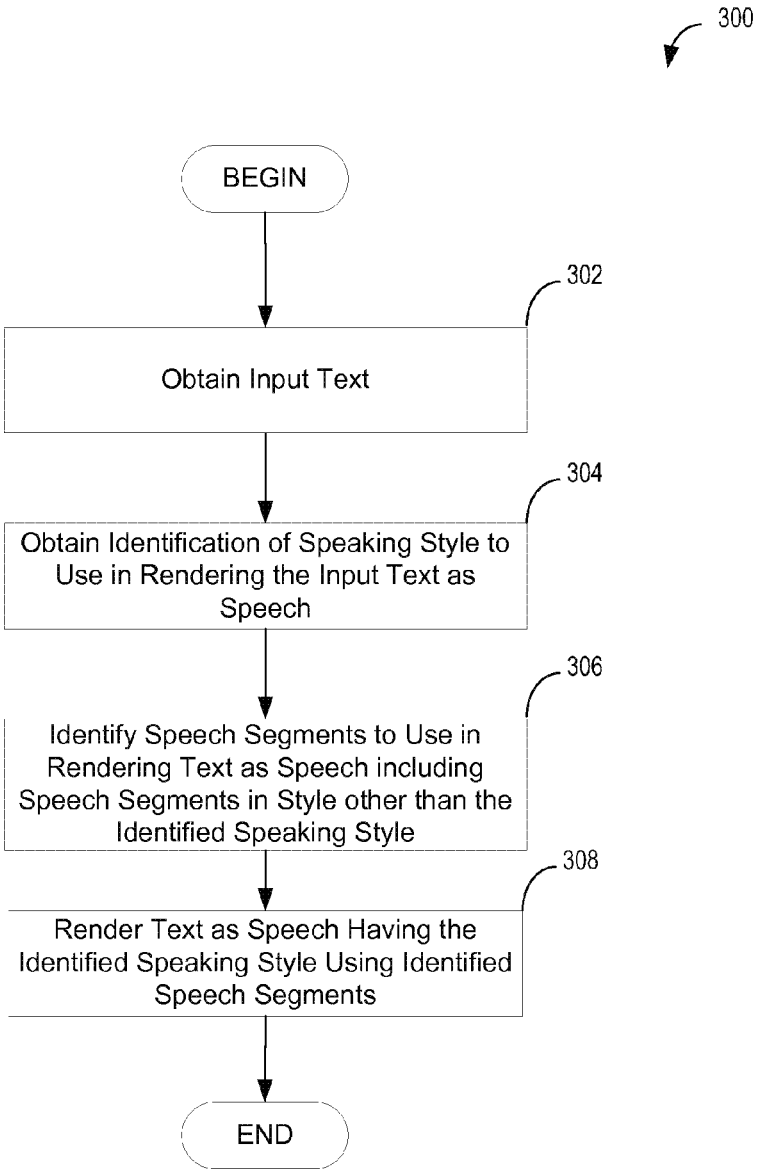
FIG. 3 is a flowchart of an illustrative process for performing multi-style concatenative speech synthesis, in accordance with some embodiments of the technology described herein.

FIG. 3 is a flowchart of an illustrative process 300 for performing multi-style concatenative speech synthesis. Process 300 may be performed by any suitable computing device(s). For example, process 300 may be performed by a computing device with which a user may interact (e.g., computing device 204), one or more remote computing devices (e.g., server 210), or at least partially by a computing device with which a user may interact and at least partially by one or more remote computing devices (e.g., at least partially by computing device 204 and at least partially by server 210).

Process 300 begins at act 302, where input text to be rendered as speech is obtained. The input text may be obtained from any suitable source. For example, the input text may be obtained from a user, from a computer program executing on a computing device with which the user is interacting (e.g., an operating system, an application program, a virtual assistant program, etc.), or any other suitable source.

Next, process 300 proceeds to act 304, where information identifying a speaking style (the "target style") to use in rendering the input text as speech is obtained. The information identifying the target style may be obtained from any suitable source. In some embodiments, the indication of the target style may be obtained from the same source as the one from which the input text was received. For example, a user or a computer program may provide text to be rendered as speech together with an indication of the style in which to render the provided text. In other embodiments, the input text and information identifying the target style may be obtained from different sources. For example, in some embodiments, the input text may be provided without an indication of the speaking style to use when rendering the text as speech and a default speaking style is selected as the target style by the computing device(s) executing process 300.

Next, process 300 proceeds to act 306, where speech segments are identified for use in rendering the text obtained at act 302 as speech having the target style. The speech segments may be identified from among candidates in an inventory of speech segments comprising speech segments in the target style and/or in one or more inventories of speech segments comprising speech segments having styles other than the target style. In this way, speech segment candidates having styles other than the target style are considered, during act 306, for selection as speech segments to be used in rendering the input text as speech having the target style.

In some embodiments, a speech segment may be identified for use in rendering the text as speech having a target style based, at least in part, on: (1) how well the acoustic and/or prosodic characteristics of the speech segment match those of the target style (e.g., by determining a "style cost" of the speech segment); (2) how well the acoustic and/or prosodic characteristics of a speech segment align with those of a target phoneme in the text to be generated (e.g., by determining a "target cost" of the speech segment); and (3)

how close acoustic and/or prosodic characteristics of a particular speech segment align with acoustic and/or prosodic characteristics of neighboring speech segments (e.g., by determining a "join cost" of the speech segment). In some embodiments, a speech segment may be identified based on any suitable combination of its style cost, target cost, join cost, or any other suitable type of cost (e.g., anomaly cost as described below with reference to FIG. 5), as aspects of the technology described herein are not limited in this respect.

In some embodiments, the speech segments to use for rendering the input text as speech may be identified by performing a Viterbi search through a lattice of style, target, and join costs (or any other suitable type of search based on the costs associated with the speech segment candidates under consideration). The Viterbi search may be performed in any suitable way and, for example, may be performed as a conventional Viterbi search would be performed on a lattice of target and join costs, but with the target cost of a speech segment being adjusted by the style cost of the segment (e.g., by adding the style cost to the target cost). In this way, speech segments having styles other than the target style would be penalized, for purposes of selection, in proportion to how different their acoustic and/or prosodic characteristics are from that of the target style. The speech segments whose acoustic and/or prosodic characteristics closely match those of the target style would have a lower style cost and be more likely used for synthesizing speech having the target style than speech segments whose acoustic and/or prosodic characteristics do not closely match those of the target style. The speech segments that have the target style have a style cost of zero. Target and join costs for a speech segment may be obtained in any suitable way, as aspects of the technology described herein are not limited in this respect. Ways in which a style cost for a speech segment may be obtained are described below.

It should be appreciated that conventional multi-style speech synthesis techniques (i.e., techniques that generate speech having a target style using only speech segments having the target style) may use target and join costs, but do not consider the style cost of a speech segment since all the speech segments used have the target style (and would therefore have style cost of 0). Furthermore, neither the target nor the join costs used in conventional multi-style speech synthesis techniques depend on style of the speech segments. By contrast, in some embodiments, speech segments having a style other than the target style are considered and selected for synthesis based, at least in part, on their style cost. In addition, in some embodiments, the target and/or join costs may themselves depend on style. For example, join costs may depend on pitch transition probabilities which may be different for each style.

As described above, the style cost of a speech segment having a style other than the target style may reflect how well the acoustic and/or prosodic characteristics of the speech segment match those of the target style. In some embodiments, the style cost of a speech segment candidate having a style different from the target style (style "NT"—"not target") and associated with a phonetic context "P" may be obtained by using a transformation from a first group of segments (including the speech segment candidate) having style "NT" and associated with the phonetic context "P" to a second group of segments having the target style and also associated with the same phonetic context "P." (As discussed above, this transformation may be a composition of a transformation from the first group to an average style group of speech segments associated with the phonetic context "P" and a transformation from the average style group to the second group). For example, when the first and second groups of segments are represented by first and second statistical models (e.g., first and second Gaussian distributions), respectively, the style cost of the speech segment candidate may be a value indicative of the similarity between the two groups that may be calculated by: (1) using the transformation to transform the first statistical model to obtain a transformed first statistical model; and (2) calculating the value as a distance (e.g., a Kullback-Liebler (KL) divergence) between the transformed first statistical model and the second statistical model. The style cost may be calculated in any other suitable way using the transformation from the first group of speech segments to the second group of speech segments, as aspects of the technology described herein are not limited in this respect.

In some embodiments, the style cost for one or more speech segments may be computed prior to execution of process 300 (e.g., during training of a multi-style TTS system) such that obtaining the style cost for a speech segment candidate may comprise accessing a previously computed style cost. For example, a value indicative of similarity between two groups of speech segments may be calculated and stored, prior to execution of process 300, for one or more (e.g., one, some, or all) pairs of speech segment groups having different styles and associated with the same phonetic context. During execution of process 300, the style cost of a speech segment candidate having style NT associated with phonetic context P may be obtained by accessing the value indicative of similarity between a group of speech segments having the style NT, including the speech segment, and associated with phonetic context P and another group of speech segments having the target style and associated with the phonetic context P. In other embodiments, the style cost for one or more speech segments may be calculated during execution of process 300 in any of the ways described herein. Accordingly, at act 306, speech segments to be used for rendering the text received at act 302 are identified based, at least in part, on their style costs.

After speech segments to be used for rendering the text are identified at act 306, process 300 proceeds to act 308 where the identified speech segments are used to render the input text as speech having the style identified by the information obtained at act 304. This may be done using any suitable concatenative speech synthesis technique or any other speech synthesis technique, as aspects of the technology described herein are not limited by the manner in which identified speech segments are combined to render input text as speech. After the input text is rendered as speech at act 308, process 300 completes.

Figure 4:
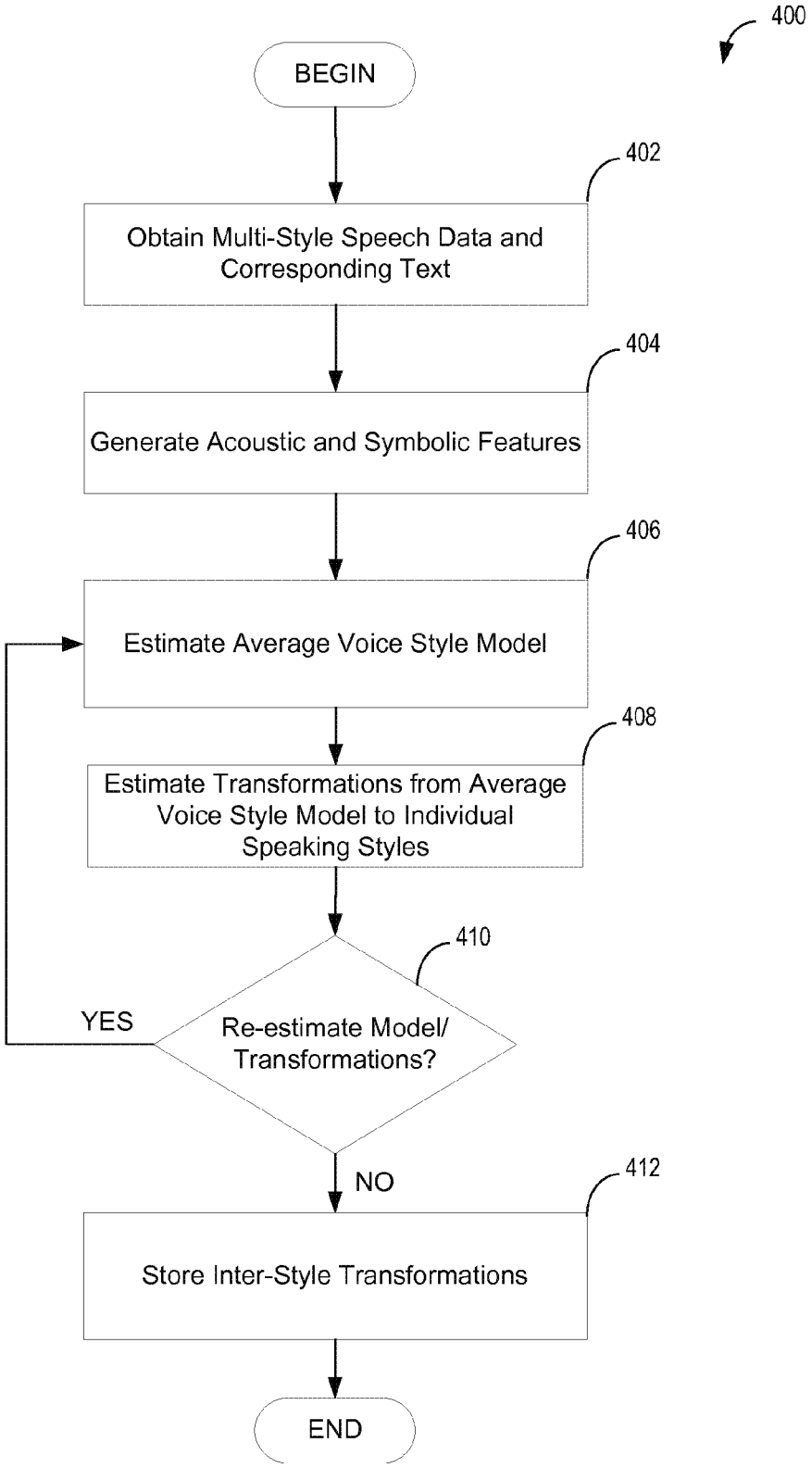
FIG. 4 is a flowchart of an illustrative process for training a speech synthesis system to perform multi-style concatenative speech synthesis, in accordance with some embodiments of the technology described herein.

FIG. 4 is a flowchart of illustrative process 400 for training a multi-style TTS synthesis system, in accordance with some embodiments of the technology described herein. Process 400 may be performed by any suitable computing device(s). For example, process 400 may be performed by a computing device with which a user may interact (e.g., computing device 204), a remote computing device (e.g., server 210), or at least in part by a computing device with which a user may interact and at least in part by a remote computing device (e.g., at least in part by computing device 204 and at least in part by server 210).

Process 400 begins at act 402, where training data comprising speech data and corresponding text is obtained. The training data may comprise speech data for each of multiple speaking styles, examples of which are provided herein. Any suitable amount of training speech data may be obtained for each of the speaking styles (e.g., at least 30 minutes, at least one hour of recorded speech, at least ten hours, at least 25 hours, at least 50 hours, at least 100 hours, etc.). Training speech data may be obtained for any suitable number of speaking styles (e.g., two, three, five, ten, etc.). Training speech data may comprise speech data collected from one or multiple speakers.

Next process 400 proceeds to act 404, where speech features are obtained from the speech data obtained at act 402 and text features (sometimes termed "symbolic" features) are obtained from the corresponding text data obtained at act 402. The speech data may be segmented into speech segments (in any suitable way) and the speech features may be obtained for each of one or more of the obtained speech segments. The speech features for a speech segment may comprise features including prosodic parameters (e.g., pitch period/frequency, duration, intensity, etc.) and acoustic parameters (e.g., Mel-frequency cepstral coefficients, linear predictive coefficients, partial correlation coefficients, formant frequencies, formant bandwidths, etc.) and/or any other suitable speech features. The speech features may be obtained in any suitable way from the speech data, as aspects of the technology described herein are not limited by the way in which acoustic features are obtained from the speech data.

The text features may include phonetic transcriptions of words in the text, part of speech information for words in the text, prominence of words in the text, stress annotation, position of words in their respective sentences, major and minor phrase boundaries, punctuation encoding, syllable counts, syllable positions within words and/or phrases, phoneme counts and positions within syllables, and information indicating the style of each speech segment obtained at act 402 (e.g., style label for each sentence), and/or any other suitable text features. The text features may be obtained in any suitable way from the text data, as aspects of the technology described herein are not limited by the way in which text features are obtained from text data.

Next, process 400 proceeds to act 406, where an average style voice model is estimated using the acoustic and symbolic features obtained at act 404. The average style model is estimated using acoustic and symbolic features derived from speech data (and corresponding text data) for multiple styles (e.g., all the speech and text data obtained at act 402) rather than using speech data (and corresponding text data) for any one particular style. As a result, the average style voice model is a model of a voice having a style influenced by each of the multiple styles for which speech data were obtained at act 402 and may be informally referred to as a voice having a style that is an "average" of the multiple styles.

In some embodiments, estimating the average style voice model may comprise clustering the speech segments into groups corresponding to different phonetic and prosodic contexts. The speech segments may be clustered into groups in any suitable way. For example, the speech segments may be iteratively clustered into groups based on a series of binary (e.g., yes/no) questions about their associated symbolic features (e.g., Is the phoneme a vowel? Is the phoneme a nasal? Is the preceding phoneme a plosive? Is the syllable to which the phoneme belongs the first syllable of a multi-syllable word? Is the word to which the phoneme belongs a verb? Is the word to which the phoneme belongs a word before a weak phrase break? etc.). For example, in some embodiments, the speech segments may be clustered using any suitable decision tree (e.g., binary decision tree) clustering technique, whereby the root and internal nodes of the decision tree generated during the clustering process correspond to particular questions about symbolic features of the speech segments and leaf nodes of the generated decision tree correspond to groups of speech segments. Each group of speech segments associated with a leaf node of the decision tree corresponds to a phonetic context defined by the series of questions and corresponding answers required to reach the leaf node from the root node of the decision tree. As another example, in some embodiments, neural network techniques may be used. For example, the speech segments may be clustered by their associated symbolic features and mapped with an output neural network layer that represents the average style voice for those symbolic features. Such a mapping may be realized through sequences of neural network layers, each layer having one or more nodes associated with respective inputs, weights, biases, and activation functions.

In some embodiments, estimating the average voice style model may further comprise estimating, for each group of speech segments, one or more statistical models to represent acoustic and/or prosodic characteristics of the speech segments in the group. For example, a statistical model may be estimated to represent acoustic characteristics of the speech segments (e.g., by deriving acoustic features from the speech segments and fitting the statistical model to the derived features). For instance, a Gaussian distribution (or any other suitable statistical model) may be fitted to Mel-frequency cepstral coefficients (and/or any other suitable acoustic features) obtained from the speech segments in the group. As another example, a statistical model may be estimated to represent prosodic characteristics of the speech segments (e.g., by deriving prosodic features from the speech segments and fitting the statistical model to the derived prosodic features). For instance, a Gaussian distribution (or any other suitable statistical model) may be fitted to pitch frequencies/periods and durations (e.g., or any other suitable prosodic features) obtained from the speech segments in the group. As another example, a single statistical model may be estimated to represent acoustic and prosodic features of the speech segments (e.g., by deriving acoustic and prosodic features from the speech segments and fitting the statistical model to the derived features). Such a statistical model may be used to estimate and represent correlations, if any, between acoustic and prosodic features of the speech segments. For instance, a Gaussian distribution (or any other suitable statistical model) may be fitted to MFCCs, pitch period/frequency, and duration features derived from the speech segments.

In some embodiments, the average style voice model may be a hidden Markov model (HMM) model. For example, the average style voice model may be a clustered context-dependent HMM model, which may be estimated from data by: (1) estimating a context-dependent (also termed a "full context") HMM for each group of speech segments associated with the same symbolic features; (2) clustering the speech segments based on their symbolic features into groups (e.g., as described above); and (3) re-estimating the context-dependent HMMs (e.g., using Baum Welch re-estimation techniques) in accordance with the clustering of the speech segments. Each of these steps may be performed in any suitable way, as aspects of the technology described herein are not limited in this respect. For example, the clustering may be performed using any suitable decision tree-based clustering technique in which case the clustered context-dependent HMM model may be referred to as a tree-clustered HMM model. In other embodiments, the average style voice model may be any other suitable type of statistical model used for speech synthesis.

Next, process 400 proceeds to act 408, where respective transformations from the average voice style model to each individual style are estimated. In some embodiments, a transformation from the average voice style model to each individual style may be estimated for each group of speech segments corresponding to a phonetic context. For example, when the average style voice model is estimated from speech data comprising speech of N different styles (e.g., where N is an integer greater than or equal to 2) and having M clusters of speech segments (e.g., where M is an integer greater than 0), up to N*M transformations may be estimated at act 408. As another example, when speech segments are clustered using a decision tree clustering technique so that each leaf of the decision tree corresponds to a phonetic and prosodic context and is associated with a group of speech segments, a transformation from the average voice style model to each (of multiple) individual styles may be estimated for each group of speech segments associated with a leaf node of the decision tree.

In some embodiments, a transformation from a group of speech segments in the average style voice model to a specific speaking style may be a transformation of a statistical model representing the group of speech segments. The transformation may be estimated by maximizing a likelihood (e.g., the log likelihood) of the statistical model with respect to features derived from only those speech segments in the group that have the specific speaking style. This may be done using maximum likelihood linear regression (MLLR) techniques or in any other suitable way. For example, a group of speech segments associated with a particular phonetic and prosodic context in the average voice style model may comprise style "A" speech segments, style "B" speech segments, and style "C" speech segments, and the acoustic characteristics of all these segments may be represented by a Gaussian distribution (e.g., a Gaussian distribution having mean $\mu$ and covariance $\Sigma$ estimated from MFCCs and/or any other suitable acoustic features derived from the speech segments). A transformation from the group of speech segments to style "A" may be a transformation T and may be estimated (e.g., the transformation T may be a matrix whose entries may be estimated) by maximizing a likelihood of the transformed Gaussian distribution (e.g., the Gaussian distribution with transformed mean $T\mu$ and covariance $T\Sigma T^t$). It should be appreciated that a transformation from a group of speech segments in the average style voice model to a specific speaking style may be estimated in any other suitable way.

In some embodiments, a first transformation $T_1$ from the average voice style model to a first speaking style "A" and a second transformation $T_2$ from the average voice style model to a second speaking style "B" may be composed to obtain a composed transformation $T_{12}$ (e.g., the composition may be performed according to $T_{12}=T_1^{-1}T_2$). Thus, a transformation between two groups of segments having different styles (e.g., styles "A" and "B") and the same phonetic context may be obtained. As discussed above, such a transformation may be used to determine whether speech segments having style "A" may be used to synthesize speech having style "B."

Next, process 400 proceeds to decision block 410, where it is determined whether the average voice style model and/or the transformations are to be re-estimated. This determination may be made in any suitable way. As one example, the determination may be made based, at least in part, on how well (e.g., in the likelihood sense) the average voice style model, when transformed to a particular style using the transformations estimated at act 408, fits the speech segments of a particular style (e.g., when the likelihood of the data given the average voice style model after transformation is above a predetermined threshold, it may be determined that the average voice style model and the transformations are to be re-estimated). As another example, the average voice style model and the transformations may be re-estimated a predefined number of times (e.g., the training algorithm is performed using a predefined number of iterations). In this case, it may be determined that the average voice style model and the transformations are to be re-estimated when they have been re-estimated fewer than the predefined number of times.

When it is determined, at decision block 410, that the average voice style model and the transformations are to be re-estimated, process 400 returns to act 406, where the average voice style model is re-estimated. The average voice style voice model may be re-estimated based, at least in part, on the transformations estimated at act 408 of process 400. For example, the average voice style model may be estimated from acoustic features of speech segments that have been transformed using the estimated transformations. For instance, if a transformation T from the average style voice model to a particular style "A" was estimated at act 408, then the average style voice model may may be estimated based at least in part on features derived from style "A" speech segments and transformed according to the inverse transformation $T^{-1}$.

On the other hand, when it is determined at decision block 410 that the average style model and the transformations are not to be re-estimated, process 400 proceeds to act 412, where the average style model and the transformations are stored. In some embodiments, during act 412, the transformations between the average style model and individual speaking styles may be used to generate composed transformations (as described above) between groups of speech segments having different speaking styles and sharing the same phonetic context. Furthermore, the composed transformations may be used to calculate values indicative of a similarity between the groups of speech segments in any of the above-described ways. The composed transformations and or the calculated values may be stored for subsequent use during speech synthesis. After act 412 is performed, process 400 completes.

It should be appreciated that the above-described TTS techniques are not limited to being applied only to multi-style TTS synthesis. For example, in some embodiments, the above-described techniques may be applied to multi-lingual TTS synthesis where, for languages that have at least partially overlapping phoneme sets, segments of speech spoken in one language may be used to generate speech in another language.

Adaptive Speech Synthesis

Conventional concatenative speech synthesis techniques may generate speech having perceived glitches due to joining of certain types of speech segments that, when concatenated, result in acoustic artifacts that a listener may hear. The inventors have recognized that such perceived glitches may result when speech segments, which are not adjacent in speech data used to train the TTS system, are spliced at or near the locations of where phonetic anomalies occur. Speech having a phonetic anomaly may comprise content pronounced in a way that deviates from how that content is expected be pronounced, for example, by a trained speaker. Examples of phonetic anomalies include rapidly spoken speech, vowel reductions, co-articulations, slurring, inaccurate pronunciations, etc.

As one example, a perceived glitch may result when a contiguous speech segment sequence (i.e., a sequence of one or more adjacent segments in the speech data used to train the TTS system) having a phonetic anomaly is concatenated with one or more speech segments not adjacent to the contiguous speech segment sequence in the speech data used to train the TTS system. As another example, dividing a contiguous speech segment sequence having a phonetic anomaly into subsequences and using the subsequences during synthesis separately from one another may result in speech having a perceived glitch. The presence of glitches in generated speech causes the speech to sound unnatural and is undesirable.

Accordingly, some embodiments are directed to techniques for identifying phonetic anomalies in speech data used by a TTS system to perform synthesis and guiding, based at least in part on results of the identification, the way in which speech segments are selected for use in rendering input text as speech. For example, in some embodiments, a contiguous speech segment sequence identified as containing a phonetic anomaly may be used as an undivided whole in generating speech so that speech segments in the contiguous sequence are not used for synthesis separate and apart from the contiguous speech segment sequence. As another example, in some embodiments, a contiguous sequence of one or more speech segments identified as having a phonetic anomaly is more likely to be concatenated with adjacent speech segments during synthesis (i.e., speech segments proximate the contiguous speech segment sequence in the speech from which the contiguous speech segment sequence was obtained) than non-adjacent speech segments. In this way, a TTS synthesis system may avoid splicing speech segments, which are not adjacent in speech data used to train the TTS system, at or near locations where phonetic anomalies occur.

In some embodiments, a contiguous sequence of one or more speech segments may be identified as having a phonetic anomaly by using automatic speech recognition techniques. As one example, a contiguous sequence of one or more speech segments having a phonetic anomaly may be identified by: (1) performing automatic speech recognition on the contiguous sequence; and (2) determining whether the contiguous sequence contains a phonetic anomaly based, at least in part, on results of the automatic speech recognition. The automatic speech recognition may be performed by using a phoneme recognizer (or any other suitable ASR technique) trained on "well-pronounced" speech data selected to have few phonetic anomalies. A phoneme recognizer recognizer trained on such well-pronounced speech may be useful for identifying phonetic anomalies because speech data comprising a phonetic anomaly would likely not be correctly recognized and/or be associated with a low recognizer likelihood or confidence. This is described in more detail below with reference to FIG. 5. As another example, results of applying a phoneme recognizer (or any suitable ASR technique) to a contiguous speech segment sequence may be processed using one or more rules to identify phonetic anomalies, as described in more detail below. As yet another example, a contiguous sequence of one or more speech segments having a phonetic anomaly may be identified by performing forced alignment of transcriptions of TTS speech data to the speech data. The forced alignment may be performed using different approaches (e.g., using models obtained by using different Mel-cepstrum dimensions, different symbolic feature sets, different clustering degrees or constraints, using different pruning thresholds, different sampling frequency of speech data, using different training data, models having different numbers of HMM states, different acoustic streams, etc.) and differences in locations of phonetic boundaries in the speech data obtained using the different approaches may indicate locations of phonetic anomalies. It should be appreciated that ASR techniques may be used in any other suitable way to identify phonetic anomalies in speech data, as aspects of the technology described herein are not limited in this respect.

In some embodiments, an anomaly score may be calculated for each of one or more contiguous speech segment sequences. In some instances, anomaly scores may be calculated for the contiguous speech segment sequences identified as having phonetic anomalies. In other instances, anomaly scores may be calculated for all contiguous speech segment sequences (in which case anomaly scores for sequences not having a phonetic anomaly may be zero or near zero). Speech segment sequences associated with higher anomaly scores are more likely to include phonetic anomalies than speech segment sequences having lower anomaly scores. Anomaly scores may be calculated in any suitable way and, for example, may be calculated using ASR techniques such as those described below with reference to FIG. 5.

In some embodiments, anomaly scores may be used to guide the way in which speech segments are selected for use in rendering text as speech. For example, anomaly scores may be used to increase the cost (e.g., in a synthesis lattice) of joining speech segment sequences having a high anomaly score to non-adjacent speech segments relative to the cost of joining these sequences to adjacent speech segments. In this way, anomaly scores may be used to bias the TTS system to avoid concatenating speech segments, which are not adjacent in speech data used to train the TTS system, at or near locations of phonetic anomalies.

FIG. 5 is a flowchart of an illustrative process 500 for identifying phonetic anomalies in speech data accessible by a TTS system at least in part by using automatic speech recognition, in accordance with some embodiments of the technology described herein. Process 500 may be performed by any suitable computing device(s). For example, process 500 may be performed by a computing device with which a user may interact (e.g., computing device 204), a remote computing device (e.g., server 210), or at least in part by a computing device with which a user may interact and at least in part by a remote computing device (e.g., at least in part by computing device 204 and at least in part by server 210).

Process 500 begins at act 502, where a phoneme recognizer is trained using speech data that contains few (if any) phonetic anomalies. The training speech data may be a subset of speech data used by a TTS system to generate speech. For example, the training speech data may comprise speech segments used by the TTS system to generate speech using concatenative speech synthesis techniques. The training speech data may be selected in any suitable way, as aspects of the technology described herein are not limited in this respect. The phoneme recognizer may be trained in any suitable way on the training data. The phoneme recognizer may be referred to as a "free" phoneme recognizer.

Next, process 500 proceeds to act 504, where the phoneme recognizer trained at act 502 is used to recognize speech data used by a TTS system to generate speech. For example, the phoneme recognizer may be applied to audio recordings from which the TTS system obtains speech segments for use in speech synthesis. In this way, the phoneme recognizer may process speech segments in the order that they appear in the audio recordings. Applying the phoneme recognizer to an audio recording may comprise extracting acoustic and/or prosodic features from the speech segments in the audio recording and generating, based on the extracted features and for contiguous sequences of one or more speech segments, respective lists of one or more phonemes to which the contiguous speech segment sequences correspond[1] together with associated likelihoods (e.g., log likelihoods) and/or confidences.

[1] Audio data corresponding to a particular phoneme may comprise one or more speech segments.

Next, process 500 proceeds to act 506, where output of the phoneme recognizer is used to identify phonetic anomalies in one or more contiguous speech segment sequences. This may be done in any suitable way based on the output of the recognizer and the phonetic transcription of the TTS speech data. For example, contiguous sequences of speech segments that were incorrectly recognized may be identified as containing phonetic anomalies. As another example, when the phoneme recognizer produces a list of potential recognitions for a contiguous speech segment sequence together with respective likelihoods and the likelihood corresponding to the correct recognition is below a predefined threshold or the correct recognition is not within a predetermined number of top results ordered by their likelihoods (e.g., within top two results, top five results, etc.), the contiguous speech segment sequence may be identified as containing a phonetic anomaly. However, the output of the phoneme recognizer may be used to identify phonetic anomalies in one or more contiguous speech segment sequences in any other suitable way, as aspects of the technology described herein are not limited in this respect.

Next, process 500 proceeds to act 508, where an anomaly score may be generated for each of one or more contiguous speech segment sequences identified as having an anomaly at act 506. The anomaly score may be indicative of the "strength" of the phonetic anomaly. For example, if the phonetic anomaly is an incorrect pronunciation, the anomaly score may indicate how different the incorrect pronunciation is from the correct pronunciation. The anomaly score may be calculated based on output of the phoneme recognizer. For example, the anomaly score for a segment sequence may be determined based, at least in part, on the likelihood associated with the correct recognition of the segment sequence. The anomaly score may be inversely proportional to the likelihood associated with the correct recognition because a lower likelihood may indicate that the segment sequence contains speech different from that on which the recognizer was trained. That is, the lower the likelihood associated with the correct recognition—the more likely it is that that the speech segment sequence contains a phonetic anomaly. However, an anomaly score for a contiguous speech segment sequence may be obtained in any other suitable way, as aspects of the technology described herein are not limited in this respect.

Next, process 500 proceeds to act 510, where the calculated anomaly scores are stored for subsequent use in speech synthesis, after which process 500 completes. As described above, the calculated anomaly scores may be used to modulate the way in which a TTS system selects speech segments for use in generating speech so that the TTS system avoids concatenating a contiguous speech segment sequence having a phonetic anomaly with non-adjacent speech segments.

It should be appreciated that process 500 is illustrative and that there are variations of process 500. For example, although in the described embodiment, a phoneme recognizer is used, in other embodiments, any suitable ASR techniques and models (e.g., acoustic models, language models, etc.) may be employed. As another example, although in the described embodiment, anomaly scores are calculated only for the speech segment sequences identified as containing a phonetic anomaly, in other embodiments, anomaly scores may be calculated for all speech segment sequences. In such embodiments, act 506 of process 500 may be eliminated.

As described above, results of applying a phoneme recognizer (or any suitable ASR technique) to contiguous speech segment sequences may be processed using one or more rules to identify the sequences that have phonetic anomalies. In some embodiments, one or more rules may be applied to various features obtained from a contiguous speech segment sequence (e.g., using a phoneme recognizer, transcription data, output of forced alignment techniques, etc.) to determine whether the segment sequence contains a phonetic anomaly. Examples of features include, but are not limited to, phonetic context features (e.g., identity of the phoneme to which the sequence corresponds, identity of the phoneme preceding the sequence, identity of the phoneme following the sequence, etc.), duration of one or more states in a finite state machine (FSM) used to model the phoneme, duration of the phoneme, and likelihoods (e.g., log likelihoods) of one or more states in a finite state machine used to model the phoneme.

As one example of a rule, a speech segment sequence corresponding to a phoneme is identified as having an anomaly when its duration is less than 24 msec. As another example of a rule, a speech segment sequence corresponding to a phoneme is identified as having an anomaly when the log likelihood of an initial phoneme state (e.g., a state used to model the initial portion of a phoneme) and/or a last phoneme state (e.g., a state used to model the last portion of a phoneme) in the FSM used to model the phoneme is less than or equal to a threshold (e.g., 15). As yet another example of a rule, a speech segment sequence corresponding to a phoneme is identified as having an anomaly when the phoneme is a front vowel, a back vowel, or a glide and the duration is either less or equal to 50 msec or greater than or equal to 300 msec.

As yet another example of a rule, a speech segment sequence corresponding to a phoneme is identified as having an anomaly when the phoneme is a glide, front vowel, or back vowel, preceded by a liquid, and the log likelihoods of an initial phoneme state and/or a last phoneme state of the FSM deviate from the average values of these log likelihoods (e.g., averaged over glides) by more than a standard deviation in the negative direction.

As yet another example of a rule, a speech segment sequence corresponding to a phoneme is identified as having an anomaly when the phoneme is a liquid preceded by a glide, front vowel, or a back vowel and the log likelihoods of an initial phoneme state and/or a last phoneme state of the FSM deviate from the average values of these log likelihoods by more than a standard deviation in the negative direction.

As yet another example of a rule, a speech segment sequence corresponding to a phoneme is identified as having an anomaly when the phoneme is a glide, front vowel, or a back vowel, and is preceded by a glide, front vowel, or a back vowel and the log likelihoods of an initial phoneme state and/or a last phoneme state of the FSM deviate from the average values of these log likelihoods by more than a standard deviation in the negative direction.

In addition to using ASR techniques for analyze contiguous speech segment sequences appearing in speech data from which a TTS system generates speech, in some embodiments ASR techniques may be applied to speech segment sequences generated by a TTS system during speech synthesis to identify speech segment sequences having phonetic anomalies. To this end, a TTS system may generate multiple different speech segment sequences for each input text. ASR techniques, including those described above, may be used to identify anomalous speech segment sequences. One or more users may verify, by listening, whether the generated speech segment sequences contain any phonetic anomalies. Speech segment sequences identified by ASR techniques, and verified by a user, as containing a phonetic anomaly may be used to guide segment selection to avoid generating the anomalous speech segment sequences.

Iterative Speech Synthesis

Conventional concatenative TTS synthesis systems search for speech segments to use in rendering text as speech based on a target model describing acoustic and/or prosodic characteristics of the speech to be generated. The search is conventionally performed in a single pass by applying a Viterbi or greedy search through a lattice of target costs and join costs for speech segment candidates. The target costs indicate how well acoustic and/or prosodic characteristics of speech segment candidates match the target model and the join costs indicate how close acoustic and/or prosodic characteristics of speech segment candidates align with acoustic and/or prosodic characteristics of neighboring speech segments.

The inventors have recognized that such conventional TTS systems may not find the best speech segments to use for rendering input text as speech because there may be a mismatch between the target model that describes acoustic and/or prosodic characteristics of the speech to be generated and those characteristics of speech segment candidates under consideration. A mismatch may arise because the target model is constructed based on limited information, information obtained from speech different from the speech used to obtain the speech segments that the TTS system uses for synthesis, and/or for other reasons. The mismatch may lead to selection of sub-optimal speech segments and result in synthesized speech that sounds unnatural. For example, the target model may comprise a target prosody model that indicates a pitch contour (e.g., a sequence of pitch frequency values) to use for synthesis and the inventory of speech segments may comprise few (if any) speech segments that match the pitch contour. As a result, the target pitch model leads to selection of sub-optimal speech segments for synthesis. As an illustrative non-limiting example, the target pitch model may indicate that speech is to be synthesized having a pitch frequency of about 150 Hz, but all the speech segment candidates under consideration have pitch frequency of about 100 Hz. In this case, all the speech segment candidates are being penalized because their pitch frequencies (near 100 Hz) are different from the target pitch frequencies (near 150 Hz), whereas it may be that the target model is incorrectly specified.

Accordingly, some embodiments provide for an iterative speech segment search technique, whereby speech segments obtained in one iteration of the search may be used to update the target model used to perform the next iteration of the search. In this way, the target model may be updated based on characteristics of the speech segment candidates themselves and the mismatch between the target model and the speech segment candidates may be reduced leading to higher quality speech synthesis.

In some embodiments, a first set of speech segments may be identified by using an initial target model describing acoustic and/or prosodic characteristics of the speech to be generated. The first set of speech segments may be used to update the initial target model to obtain an updated target model describing acoustic and/or prosodic characteristics of the speech to be generated. In turn, a second set of speech segments may be identified by using the updated target model. The second set of speech segments may be used to further update the updated target model and obtain a second updated target model. A third set of speech segments may be identified using the second updated target model. This iterative search process may continue until a stopping criterion is satisfied (e.g., when a measure of mismatch between the target model and the selected speech segments is below a predefined threshold, a predetermined number of iterations have been performed, etc.).

In some embodiments, updating a target model based on a set of speech segments may comprise extracting acoustic and/or prosodic features from speech segments in the set and updating the target model based on the extracted features. For example, the set of speech segments may comprise a sequence of speech segments and a pitch contour may be extracted from the sequence of speech segments. The extracted pitch contour may be used to replace or modify (e.g., by averaging the extracted pitch contour with) the pitch contour of the target model.

In some embodiments, in addition to or instead of updating the target model, other aspects of the search for speech segments may be updated between iterations of the multi-pass search technique. For example, a coarse join cost function may be used in one iteration of the search (e.g., a binary flag indicating a cost of 0 when the segments are adjacent in the speech from which they are obtained and a cost of 1 when they are not adjacent) and a refined join cost function (e.g., based on a measure of distance between acoustic and/or prosodic features of the speech segments) may be used in a subsequent iteration. As another example, a low-beam width search may be performed in one iteration of the search and a wider beam-width search may be performed in a subsequent iteration. As yet another example, a small set of acoustic and/or prosodic features of each speech segment candidate may be compared with the target in one iteration of the search and larger set of acoustic and/or prosodic features (e.g., a superset of the small set) may be compared with the target model in a subsequent iteration.

Accordingly, in some embodiments, an initial iteration of the multi-pass search technique may be used to perform a coarse search for speech segments to identify an initial set of speech segments, update the target model based on the initial set of speech segments, and perform a refined search for speech segments to identify a refined set of speech segments. For example, an initial iteration of the multi-pass search technique may be used to perform a coarse search by using a subset of linguistic features (e.g., phonetic context, word position, and word prominence), a low beam width search, and a coarse join function (e.g., a binary-valued function as described above). The initial search iteration may be used to quickly identify speech segment sequences that match the prosody pattern of word prominence. The speech segments identified during the initial iteration may be used to update the pitch frequency contour of the target model. Then, a refined search for speech segments may be performed by using additional linguistic features, the refined target model (having a refined pitch frequency contour), a wider beam-width search, and a join function that compares acoustic and/or prosodic characteristics of speech segments.

FIG. 6 is a flowchart of an illustrative process 600 for performing a multi-pass search for speech segments to use for rendering input text as speech via concatenative synthesis, in accordance with some embodiments of the technology described herein. Process 600 may be performed by any suitable computing device(s). For example, process 600 may be performed by a computing device with which a user may interact (e.g., computing device 204), a remote computing device (e.g., server 210), or at least in part by a computing device with which a user may interact and at least in part by a remote computing device (e.g., at least in part by computing device 204 and at least in part by server 210). Each iteration of search (e.g., as described with reference to act 606 of process 600) may be performed by one or multiple processors. That is, each iteration of search may be parallelized.

Process 600 begins at act 602, where input text to render as speech is obtained. The input text may be obtained from any suitable source. For example, the input text may be obtained from a user, from a computer program executing on a computing device with which the user is interacting (e.g., an operating system, an application program, a virtual assistant program, etc.), or any other suitable source.

Next, process 600 proceeds to act 604, where a target model for the speech to be generated is obtained. The target model may be obtained in any suitable way and may comprise any suitable information including information describing acoustic and/or prosodic characteristics of the speech to be generated. As one example, the target model may comprise a prosody target model characterizing prosodic characteristics of the speech to be generated. The prosody target model may comprise information indicating a pitch frequency or period contour of the speech to be generated, information indicating durations of phonemes in the speech to be generated, information indicating a word prominence contour of the speech to be generated, and/or any other suitable information. As another example, the target model may comprise an acoustic target model indicating spectral characteristics of the speech to be generated.

Next, process 600 proceeds to act 606, where a set of speech segments is identified based, at least in part, on the target model obtained at act 604. In some embodiments, the target model may be used to obtain target costs for speech segment candidates indicating how well acoustic and/or prosodic characteristics of speech segment candidates match the target model. The target costs, together with join costs indicating how close acoustic and/or prosodic characteristics of speech segment candidates align with acoustic and/or prosodic characteristics of neighboring speech segments and/or any other suitable cost such as the style and anomaly costs described herein, may be used to identify the set of speech segments. This may be done in any suitable way and, for example may be done by applying a search technique (e.g., a Viterbi search, a beam search, a greedy search, etc.) to a lattice of target, join and/or any other costs for the speech segment candidates.

Next, process 600 proceeds to act 608, where the target model obtained at act 604 is updated based, at least in part, on the set of speech segments identified at act 606. Updating the target model may comprise extracting features from at least some of the speech segments identified at act 606 and updating the target model based on the extracted features. In some embodiments, the target model may comprise a target prosody model, and the target prosody model may be updated based on pitch information (e.g., pitch period, pitch frequency) obtained from at least some of the speech segments obtained at act 606. For instance, a pitch contour may be extracted from a sequence of speech segments and the extracted contour may be used to update the pitch contour in the target prosody model. The extracted pitch contour may be used to update the pitch contour in the target prosody model in any suitable way. As one example, the extracted pitch contour may be used to replace the pitch contour in the target prosody model. As another example, the extracted pitch contour may be combined (e.g., by computing an unweighted or weighted average) with the pitch contour in the target prosody model to obtain an updated pitch contour. In some embodiments, the target model may comprise an acoustic target model that may be updated based on acoustic features (e.g., cepstral coefficients) obtained from at least some of the speech segments obtained at act 606.

Next, process 600 proceeds to decision block 610, where it is determined whether another iteration of search for speech segments is to be performed. This determination may be made in any suitable way. For example, in some embodiments, process 600 may be configured to perform a predefined number of iterations. In such embodiments, when the number of iterations performed is less than the predefined number of iterations, it may be determined that another iteration of search is to be performed. As another example, in some embodiments, it may be determined that another iteration of search is to be performed when a distance between the updated target model and the selected speech segments is above a predefined threshold (thereby indicating a mismatch between the target model and the speech segments identified during the last iteration of search). For example, it may be determined that another iteration of search is to be performed when an average distance between the target pitch contour and the pitch of the speech segments is below a predefined threshold.

When it is determined, at decision block 610, that another iteration of search is to be performed, process 600 returns, via the YES branch, to act 606 where another set of speech segments is identified based, at least in part, on the updated target model obtained at act 608. In some embodiments, the same inventory of speech segment candidates may be searched each time act 606 is performed, though other embodiments are not so limited.

As described above, aspects of the search other than the target model may be modified between successive iterations of the multi-pass search technique. For example, different join costs functions, different anomaly cost functions, and/or different style cost functions may be used (in a pair of) successive iterations. As another example, different search algorithm parameters (e.g., beam width) may be used in different pairs of successive iterations. As yet another example, different sets of acoustic and/or prosodic features of the speech segment candidates may be compared with the target model in a pair of successive iterations.

On the other hand, when it is determined, at decision block 610 that another iteration of search is not to be performed, process 600 proceeds, via the NO branch, to act 612, where the input text is rendered as speech using the identified speech segments. This may be performed using any suitable concatenative speech synthesis technique, as aspects of the technology described herein are not limited in this respect.

Figure 7:
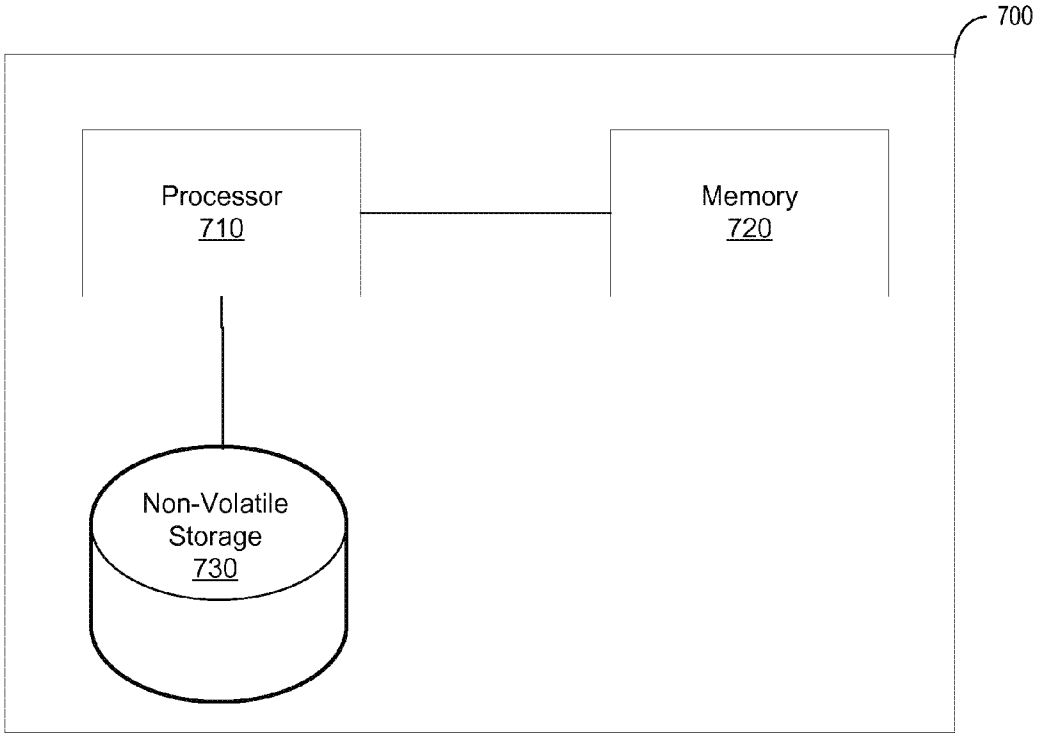
FIG. 7 is a block diagram of an illustrative computer system that may be used in implementing some embodiments of the technology described herein.

An illustrative implementation of a computer system 700 that may be used in connection with any of the embodiments of the disclosure provided herein is shown in FIG. 7. The computer system 700 may include one or more processors 710 and one or more articles of manufacture that comprise non-transitory computer-readable storage media (e.g., memory 720 and one or more non-volatile storage media 730). The processor 710 may control writing data to and reading data from the memory 720 and the non-volatile storage device 730 in any suitable manner, as the aspects of the disclosure provided herein are not limited in this respect. To perform any of the functionality described herein, the processor 710 may execute one or more processor-executable instructions stored in one or more non-transitory computer-readable storage media (e.g., the memory 720), which may serve as non-transitory computer-readable storage media storing processor-executable instructions for execution by the processor(s) 710.

The terms "program" or "software" are used herein in a generic sense to refer to any type of computer code or set of processor-executable instructions that can be employed to program a computer or other processor to implement various aspects of embodiments as discussed above. Additionally, it should be appreciated that according to one aspect, one or more computer programs that when executed perform methods of the disclosure provided herein need not reside on a single computer or processor, but may be distributed in a modular fashion among different computers or processors to implement various aspects of the technology described herein.

Processor-executable instructions may be in many forms, such as one or more program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in one or more non-transitory computer-readable storage media in any suitable form. For simplicity of illustration, data structures may be shown to have fields that are related through location in the data structure. Such relationships may likewise be achieved by assigning storage for the fields with locations in a non-transitory computer-readable medium that convey relationship between the fields. However, any suitable mechanism may be used to establish relationships among information in fields of a data structure, including through the use of pointers, tags or other mechanisms that establish relationships among data elements.

Also, various inventive concepts may be embodied as one or more processes, of which examples have been provided. The acts performed as part of each process may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the techniques described herein in detail, various modifications, and improvements will readily occur to those skilled in the art. Such modifications and improvements are intended to be within the spirit and scope of the disclosure. Accordingly, the foregoing description is by way of example only, and is not intended as limiting. The techniques are limited only as defined by the following claims and the equivalents thereto.

What is claimed is:

1. A speech synthesis method, comprising:

using at least one computer hardware processor to perform:

obtaining input comprising text and an identification of a desired speaking style to use in synthesizing the text as speech;

identifying a plurality of speech segments for use in synthesizing the text as speech, the identifying comprising identifying a first speech segment recorded and/or synthesized in a first speaking style that is different from the desired speaking style based at least in part on a measure of similarity between the desired speaking style and the first speaking style;

synthesizing speech from the text in the desired speaking style at least in part by using the first speech segment; and outputting the synthesized speech.

2. The speech synthesis method of claim 1, wherein the identifying the first speech segment is based at least in part on how well acoustic characteristics of the first speech segment match acoustic characteristics associated with the desired speaking style.

3. The speech synthesis method of claim 2, wherein the identifying the first speech segment is based at least in part on how well prosodic characteristics of the first speech segment match prosodic characteristics associated with the desired speaking style.

4. The speech synthesis method of claim 2, wherein the identifying the first speech segment comprises:

calculating a value indicative of how well the acoustic characteristics of the first speech segment match the acoustic characteristics associated with the desired speaking style.

5. The speech synthesis method of claim 4, wherein the calculating is performed based at least in part on a transformation from a first group of speech segments recorded and/or synthesized in the first speaking style to a second group of speech segments recorded and/or synthesized in the desired speaking style, wherein the first group of speech segments comprises the first speech segment, wherein the first and second groups of speech segments are associated with a same phonetic context.

6. The speech synthesis method of claim 5, wherein the first group of speech segments is represented by a first statistical model and the second group of speech segments is represented by a second statistical model, and wherein the calculating comprises:

using the transformation to transform the first statistical model to obtain a transformed first statistical model; and calculating the value as a distance between the transformed first statistical model and the second statistical model.

7. The speech synthesis method of claim 6, wherein the distance between the transformed first statistical model and the second statistical model is a Kullback-Liebler divergence between the transformed first statistical model and the second statistical model.

8. The speech synthesis method of claim 1, wherein the identifying the plurality of segments comprises:

identifying a second speech segment recorded and/or synthesized in a second speaking style that is the same as the desired speaking style.

9. The speech synthesis method of claim 8, wherein the synthesizing comprises:

synthesizing speech from the text in the desired speaking style at least in part by using the first speech segment and the second speech segment.

10. The speech synthesis method of claim 9, wherein the synthesizing comprises:

generating speech by applying at least one concatenative synthesis technique to the first speech segment and the second speech segment.

11. A system, comprising:

at least one computer hardware processor; and at least one non-transitory computer-readable storage medium storing processor-executable instructions that, when executed by the at least one computer hardware processor, cause the at least one computer hardware processor to perform:

obtaining input comprising text and an identification of a desired speaking style to use in synthesizing the text as speech;

identifying a plurality of speech segments for use in synthesizing the text as speech, the identifying comprising identifying a first speech segment recorded and/or synthesized in a first speaking style that is different from the desired speaking style based at least in part on a measure of similarity between the desired speaking style and the first speaking style;

synthesizing speech from the text in the desired speaking style at least in part by using the first speech segment; and outputting the synthesized speech.

12. The system of claim 11, wherein the identifying the first speech segment is based at least in part on how well acoustic characteristics of the first speech segment match acoustic characteristics associated with the desired speaking style.

13. The system of claim 12, wherein the identifying the first speech segment comprises:

calculating a value indicative of how well the acoustic characteristics of the first speech segment match the acoustic characteristics associated with the desired speaking style.

14. The system of claim 13, wherein the calculating is performed based at least in part on a transformation from a first group of speech segments recorded and/or synthesized in the first speaking style to a second group of speech segments recorded and/or synthesized in the desired speaking style, wherein the first group of speech segments comprises the first speech segment, wherein the first and second groups of speech segments are associated with a same phonetic context.

15. The system of claim 14, wherein the first group of speech segments is represented by a first statistical model and the second group of speech segments is represented by a second statistical model, and wherein the calculating comprises:

using the transformation to transform the first statistical model to obtain a transformed first statistical model; and calculating the value as a distance between the transformed first statistical model and the second statistical model.

16. At least one non-transitory computer-readable storage medium storing processor-executable instructions that, when executed by at least one computer hardware processor, cause the at least one computer hardware processor to perform:

obtaining input comprising text and an identification of a desired speaking style to use in synthesizing the text as speech;

identifying a plurality of speech segments for use in synthesizing the text as speech, the identifying comprising identifying a first speech segment recorded and/or synthesized in a first speaking style that is different from the desired speaking style based at least in part on a measure of similarity between the desired speaking style and the first speaking style;

synthesizing speech from the text in the desired speaking style at least in part by using the first speech segment; and outputting the synthesized speech.

17. The at least one non-transitory computer-readable storage medium of claim 16, wherein the identifying the first speech segment is based at least in part on how well acoustic characteristics of the first speech segment match acoustic characteristics associated with the desired speaking style.

18. The at least one non-transitory computer-readable storage medium of claim 17, wherein the identifying the first speech segment comprises:

calculating a value indicative of how well the acoustic characteristics of the first speech segment match the acoustic characteristics associated with the desired speaking style.

19. The at least one non-transitory computer-readable storage medium of claim 18, wherein the calculating is performed based at least in part on a transformation from a first group of speech segments recorded and/or synthesized in the first speaking style to a second group of speech segments recorded and/or synthesized in the desired speaking style, wherein the first group of speech segments comprises the first speech segment, wherein the first and second groups of speech segments are associated with a same phonetic context.

20. The at least one non-transitory computer-readable storage medium of claim 19, wherein the first group of speech segments is represented by a first statistical model and the second group of speech segments is represented by a second statistical model, and wherein the calculating comprises:

using the transformation to transform the first statistical model to obtain a transformed first statistical model; and calculating the value as a distance between the transformed first statistical model and the second statistical model.

* * * * *